US005353714A

United States Patent [19]

Hardy

[11] Patent Number: 5,353,714

[45] Date of Patent: Oct. 11, 1994

[54] DISPLAY SYSTEM

[75] Inventor: Stephen N. Hardy, Copely, Ohio

[73] Assignee: RTC Industries, Inc., Chicago, Ill.

[21] Appl. No.: 34,501

[22] Filed: Mar. 19, 1993

Related U.S. Application Data

[63] Continuation-in-part of Ser. No. 973,176, Nov. 9, 1992.

[51] Int. Cl.[5] ..... A47B 9/00

[52] U.S. Cl. ..... 108/108; 108/180; 211/184

[58] Field of Search ..... 108/108, 111, 61, 180, 108/185, 192, 193; 211/184, 43, 109, 186; 40/642, 661, 649

[56] References Cited

U.S. PATENT DOCUMENTS

| | | | |
|---|---|---|---|
| 1,814,091 | 7/1931 | Mically | 108/61 |
| 2,043,760 | 6/1936 | Marsh | 40/642 |
| 2,108,950 | 2/1938 | Stober | 211/184 X |
| 2,863,567 | 12/1958 | Friar | 211/184 X |
| 3,141,423 | 7/1964 | Christensen | 108/111 |
| 3,938,666 | 2/1976 | Castleberry | 211/184 X |
| 4,152,851 | 5/1979 | Goldstein | 40/642 |
| 4,418,627 | 12/1983 | Baker | 108/111 X |
| 4,595,105 | 6/1986 | Gold | 211/184 X |
| 4,688,341 | 8/1987 | Castel | 40/642 X |

FOREIGN PATENT DOCUMENTS

| | | | |
|---|---|---|---|
| 1347704 | 11/1963 | France | 40/642 |
| 683975 | 2/1962 | Italy | 108/60 |
| 381072 | 10/1964 | Switzerland | 40/642 |
| 2125765 | 3/1984 | United Kingdom | 40/642 |

*Primary Examiner*—Jose V. Chen

*Attorney, Agent, or Firm*—Dressler, Goldsmith, Shore & Milnamow, Ltd.

[57] ABSTRACT

A display system consisting of a plurality of vertically disposed shelves and transversely spaced and vertically disposed dividers to form a series of bins defined by said shelves and dividers. The dividers are held in place by brackets and pins. The brackets fit into grooves defined by the dividers and are held in place by pins that secure the dividers to an adjacent vertical shelf. The dividers contain grooves in their upper surface adjacent the front ends thereof into which transversely extending J-shaped members fit. The J-shaped members are designed to contain advertising material and are of a size to cover the gap between the dividers and an adjacent shelf.

12 Claims, 3 Drawing Sheets

DISPLAY SYSTEM

This is a continuation-in-part of patent application Ser. No. 07/973,176, filed Nov. 9, 1992.

BACKGROUND OF THE INVENTION

In retail stores, it is common to find display systems that include a plurality of rectangular compartments or bins for displaying various items in separate sections, such as, shirts, sweaters, linens, slacks, and so forth. In the typical super store, such as, a Walmart, K Mart, etc., these bins are usually installed when the store is first built, and consist of wooden constructions that are in fixed positions and are relatively expensive to install. This cost and construction is usually warranted since these are intended to be permanent installations and once in place, it will not be necessary to make any adjustments. These types of units perform the desired function in a satisfactory manner.

However, in today's fast changing environment, fixed, expensive bins of the type initially installed must be broken down or moved due to the constantly changing modernization of stores including the moving around of departments employing such bins. It is not uncommon for stores to be completely renovated with the relocating of a large number of store fashion centers and the like to accommodate different traffic flows and the location of different displays in different parts of the store.

It can thus be appreciated that it would be very desirable to have display systems that provide for separate bins for displaying the requisite articles constructed in such a way that they can be readily adjusted and moved if desired without incurring any large expenses or down time for the department in question. It is common practice today for shelving, such as, a conventional gondola-type shelving, to be readily moved from one location in the store to another, but in the case of bins, this has not been possible, since as aforementioned, they are usually permanent installations. Accordingly, if one were to design a construction where conventional gondola-type shelving can be used and readily and efficiently modified to provide the desired bin arrangement, this would have substantial commercial importance and give the stores the flexibility that they desire. It is important that the bins be easy to install yet provide the desired support to accommodate the items to be located in the bins. In addition, it would be desirable to provide information relating to the products in the bin which can be readily changed when desired. Also, of course, such a design must have clean lines and present no unnecessary projections that can cause injuries to customers handling the items in the bins. Of basic importance is that the system be allowed to utilize the standard gondola shelving which is employed throughout the stores.

SUMMARY OF THE INVENTION

In accordance with the present invention, there is provided a display system consisting of a plurality of bins for the display of items, such as, linens, toweling, etc., that with the addition of a novel combination of dividers and fastening means in conjunction with conventional gondola shelving provide a novel low-cost, highly efficient, quickly installed bin display. In addition, it is desirable that the system be readily adjustable in the event it is desired to change the bin configuration, while at the same time insuring that adequate support is provided for the products being stored in the display system. The system also provides an assemblage whereby the information regarding the products in the bin is readily ascertainable.

In addition, it is desirable that the system consist of very simple parts that can be readily fabricated and thus relatively inexpensive, In accordance with the present invention, the novel bin display system comprises the utilization of standard gondola-type shelving wherein transversely spaced dividers can be readily located and supported in position relative to the vertically spaced shelving by securing the dividers in place relative to the shelving at transversely spaced locations.

In the preferred embodiment, the dividers are located in place by simple pin and wire bracket constructions, which constructions are located essentially within the interior of the shelving and thus present no projection or impediment to the store customer utilizing the shelving. The dividers forming the bins in conjunction with the shelving are vertically located in position by locating wire supports extending through the shelving into grooves formed in the bottom of the dividers and pins that extend through openings in vertically adjacent shelves and into holes located in the top of the dividers. To prevent there being unwanted projections extending through the upper shelf of the system, a wire bracket is generally U-shaped with the legs extending through the shelves into the dividers and the base of the bracket provides a flat surface on the upper surface of the shelf.

The dividers are provided with C-shaped grooves in their upper surface adjacent the front edge thereof for receiving the bottom leg of a transversely extending member having a generally J-shaped cross section. The J-shaped member covers the space between the upper surface of the divider and the adjacent shelf and may, as in the illustrated embodiment, extend upwardly to shelf level. The J-shaped member is provided with a track for receiving graphics that will contain copy space to indicate the item located in the bin, the price of the product, etc.

DESCRIPTION OF THE DRAWINGS

Referring now to the drawings, there is illustrated in

DETAILED DESCRIPTION

Figure 1:
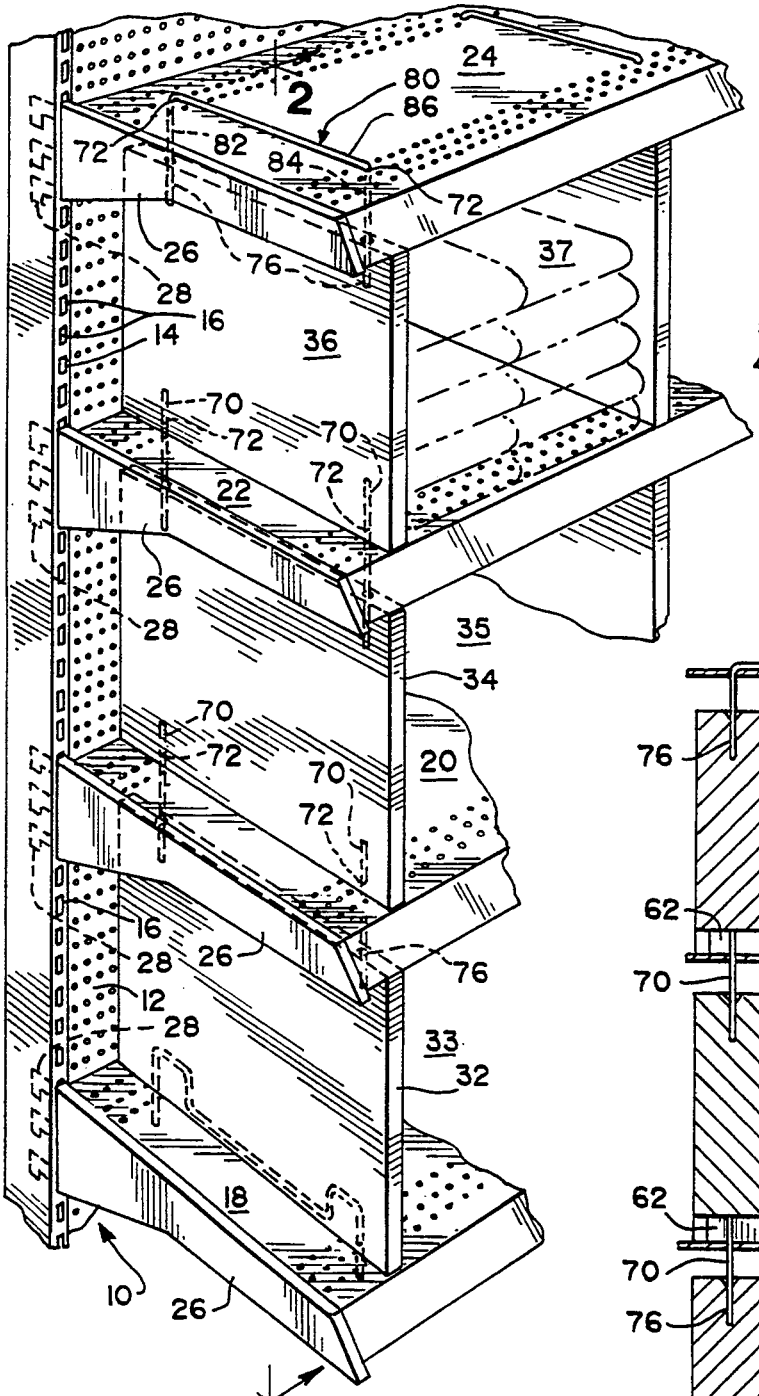
FIG. 1 a perspective view of a portion of a shelving showing a plurality of transversely spaced dividers located in vertical alignment.

As previously mentioned, applicant's novel bin display system utilizes a standard gondola-type construction 10 including a back wall 12 having a plurality of openings and spaced integral standards 14 (only one is illustrated) defining a plurality of vertically spaced openings 16. It also includes a base portion which is not illustrated- Supported off the standards in the illustrated embodiment are a plurality of shelves 18,20,22,24. Secured to the ends of each shelf is a hanging bracket 26 that includes at its inner end tabs 28 that fit into the openings 16 in the standards 14 to retain the shelf in position relative to the gondola structure. To provide additional support for the shelving transversely extending brackets 30 are secured to the under surface of the shelves (see FIG. 2). Thus, what has been described is a conventional gondola shelving that is commonly found in department stores, and the like, that is used for displaying store items thereon.

In accordance with the present invention, there is provided a unique arrangement of parts for modifying such gondola shelving to provide a bin construction. This includes the introduction of a plurality of spaced dividers 32,34,36, etc., that form in conjunction with the gondola construction vertically and horizontally spaced bins 33,36,37, etc., for the storage of articles, such as, towels, linens, slacks, blouses, and so forth.

While only dividers 32,34,35 are discussed in detail, it is to be noted that these are provided throughout the width of the shelves 18,20, etc., to provide the desired bin construction.

The structure for mounting the dividers 32,34,36 relative to the shelves 18,20,22,24 consists of brackets and pins that interconnect with the shelves and dividers to quickly and easily mount them in position.

To fully understand the construction and the assembling procedure, we will begin with the installation of the divider 32 between the bottom shelf 18 and the vertically spaced adjacent shelf 20.

Figure 3:
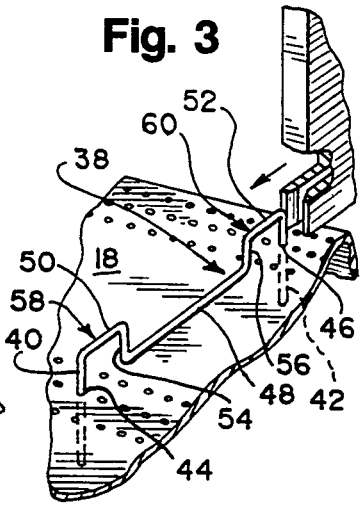
FIG. 3 is a broken away view showing the mounting of the divider relative to the bottom shelf.

Referring now to FIG. 3, there is illustrated a generally U-shaped bracket 38 that includes end legs 40 and 42 which are disposed in commonly provided shelf openings 44,46, respectively, in the shelf 18. The center portion of the U-shaped bracket 38 consists of another U-shaped portion 48 that connects with horizontally disposed portions 50,52 thereof, which interconnect the legs 54,56 of U-shaped portion 48 with legs 40,42 to define upwardly extending projections 58,60. The disposition of the legs 40,42 of the bracket 38 into the openings 44,46 of the shelf 18 extends therethrough until the bracket 48 rests on the upper portion of the shelf 18.

Figure 6:
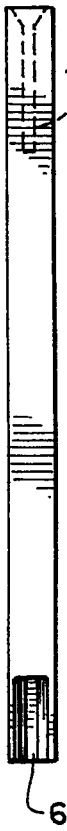
FIG. 6 is a side view of a divider.
Figure 4:
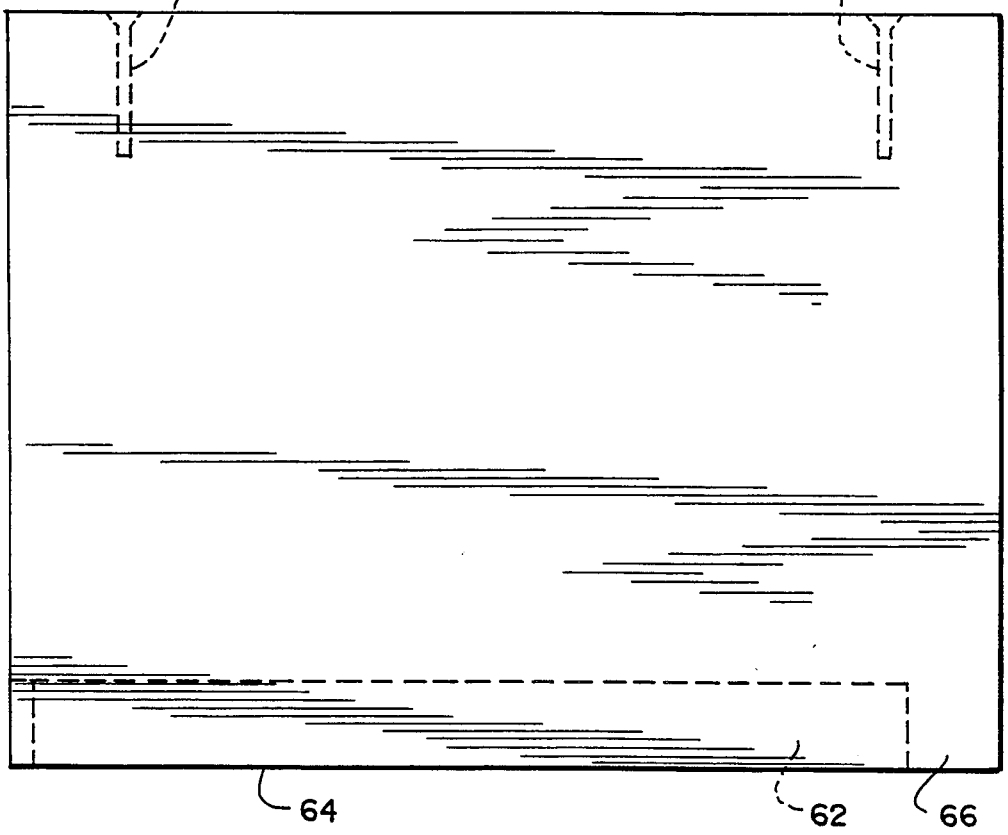
FIG. 4 is a front view of a divider.
Figure 7:
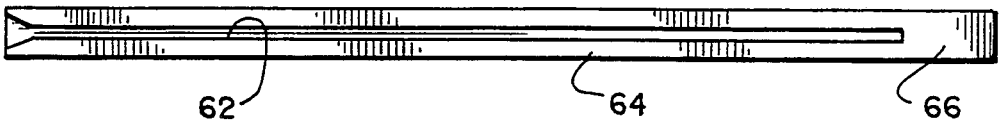
FIG. 7 is a bottom view of a divider.

The divider 32 is provided with a groove 62 in its bottom surface 64 which is shown in FIGS. 4, 6, and 7. This groove extends substantially the entire length of the divider bottom portion 64 up to the end area 66. The divider groove 62 when slid over the wire bracket projections 58,60 will accommodate the bracket 38 to retain the divider 32 in position relative to the bottom shelf 18.

In order to retain the divider in position between adjacent shelves 18 and 20, pins 70 are disposed through openings 72 in the shelf 20 and into openings 76 provided in the upper wall of the divider 32. These pins 70 are of a length to extend into the opening 76 and to extend a generally equivalent amount above the shelf 20 in the manner shown in detail in FIG. 2. After the installation of the divider 32, a second divider 34 with its groove 62 surrounding the pins 70 will be located in position between the shelves 20 and 22 to retain the divider in position relative to the shelf 20. Pins 70 are then provided through openings 72 in shelf 22 in the same manner as pins 70 were positioned with respect to shelf 20 and divider 32 with the result that divider 34 will be retained in its position between shelves 20 and 22. This assemblage of the dividers will be installed until the requisite bins are formed in the system.

While this arrangement can be used throughout the bin construction, it may be desirable not to use pins between the top shelf and the uppermost divider 36. To eliminate there being pins 70 extending above the top shelf, a U-shaped bracket 80 may be installed in place of the pins.

The U-shaped bracket 80 includes legs 82,84 that extend through openings 72 in the shelf 24 and into the openings 76 in the divider 36 to where the flat portion 86 of the U-shaped bracket 80 is flush with the shelf 24.

Figure 8:
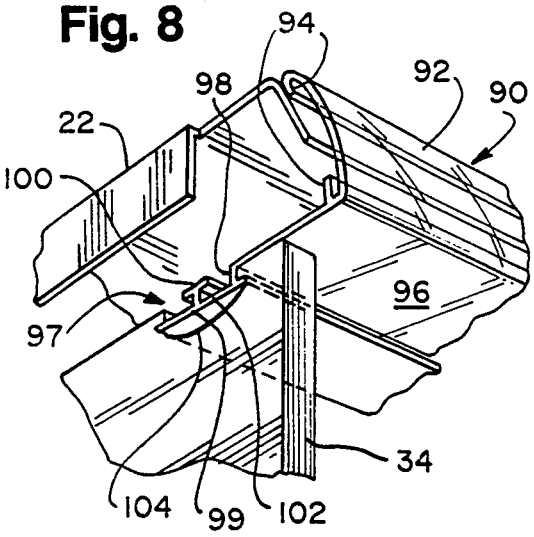
FIG. 8 is a partial perspective view illustrating the advertising graphic support member in position.
Figure 10:
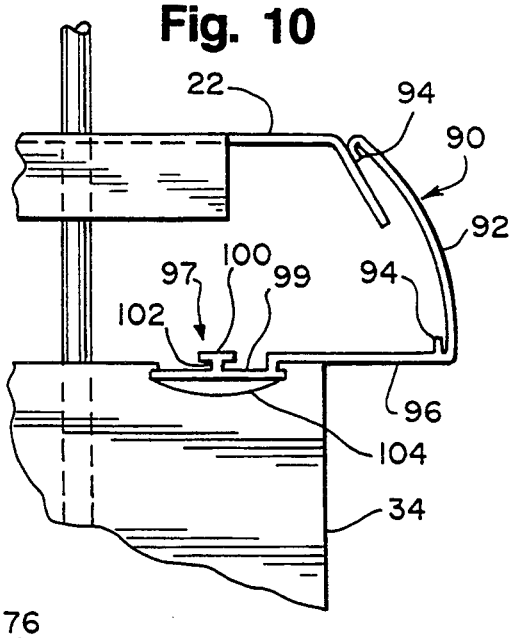
FIG. 10 is an enlarged view of the mounting structure of advertising graphic support.

Referring now to FIG. 8, there is illustrated in partial perspective a view showing the transversely extending advertising graphic assembly 90 located in position relative to adjacent dividers, only one of which is shown, and extending transversely across the front of the shelf 22. In this embodiment, the assembly 90 extends upwardly to the level of shelf 22.

More specifically, the graphic assembly 90 consists of a generally J-shaped member having a front face portion 92 which in the illustrated embodiment is made of clear plastic, but it is not limited thereto. The front face portion 92 includes flange portions 94 on its rear face that define a track into which material can be inserted to identify the product located in the bin below. The graphic assembly 90 also includes a generally horizontally extending leg portion 96 that includes at its end an inverted generally T-shaped assembly 97 which is connected by a vertically disposed flange 98 to an adjacent portion of the bottom wall 96. The inverted T-shaped assembly 97 consists of a relatively large horizontally extending section 99 connected to a substantially smaller horizontally extending section 99 by a vertically disposed connecting member 102.

The graphic assembly 90 is retained in the position shown by providing generally C-shaped grooves 104 in the upper front portions of adjacent dividers, only one of which is shown in FIG. 8. The inverted T-shaped assembly is press-fitted into grooves 104 and is retained therein to affix the graphic assembly in position relative to the lip of the vertically spaced shelf 22. Essentially, the section 100 is pressed downwardly to locate the ends of the section 98 under the turned-in portions of the C-shaped groove 104.

Figure 2:
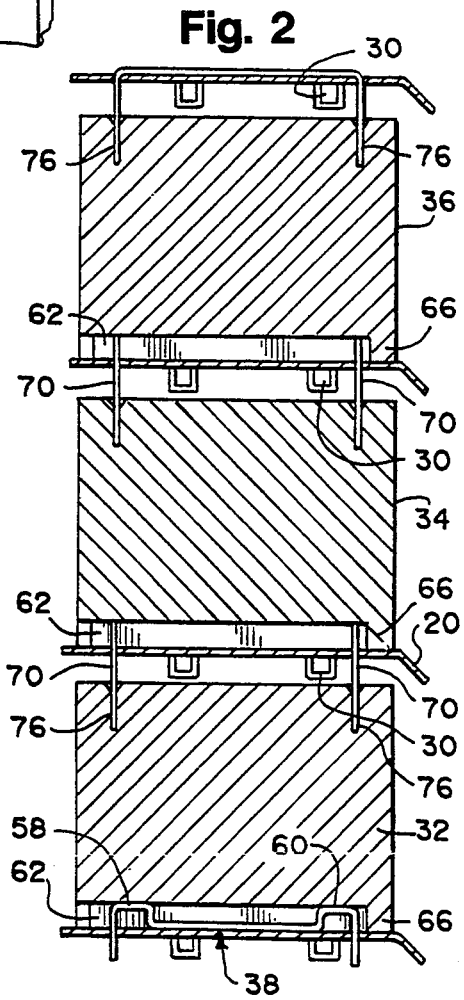
FIG. 2 is a view taken along line 2—2 of FIG. 1.
Figure 5:
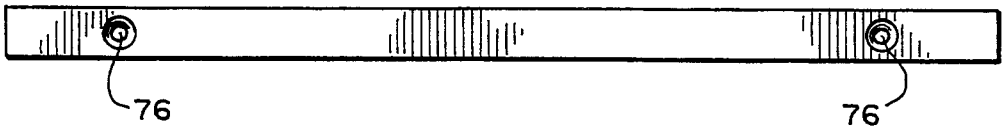
FIG. 5 is a plan view of a divider.
Figure 9:
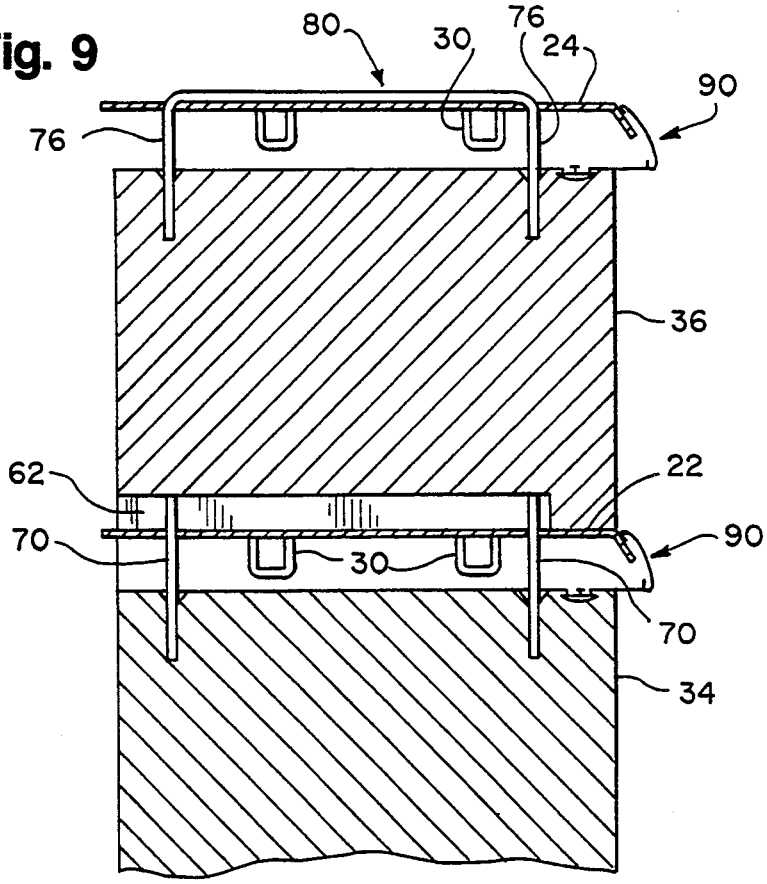
FIG. 9 is a view similar to the upper portion of FIG. 2, with the advertising graphics mounted in place.

It can be appreciated that this method of installing the dividers is repeated in the transverse and vertical direction with respect to the shelving in order to provide and locate in position the dividers to form the desired bin construction. Following this, the graphic assemblies 90 are installed in position relative to the dividers and shelves to provide for the location of the desired advertising and pricing materials. The cross-sectional views shown in FIGS. 2 and 9 give a clear picture of the dividers and graphic assemblies assembled in conjunction with the shelves.

It is intended to cover by the appended claims all such modifications that fall within the true spirit and scope of the invention.

What is claimed is:

1. A display system comprising a plurality of vertically spaced shelves defining openings and transversely spaced rows of dividers including an initial and additional vertically spaced dividers and an uppermost divider forming a bin construction, means for supporting the shelves in position relative to a shelf support, means for retaining a plurality of transversely spaced dividers in position relative to vertically spaced shelves, the initial divider in each row being retained in position by a wire bracket constructed and arranged to fit into shelf openings and including projections extending above said shelf, the dividers forming one wall of a bin and extending between said shelf and an adjacent vertically disposed shelf and defining a slot at one end for receiving said projections and defining holes for receiving pin means at its other end, pin means extending through openings defined by said adjacent vertically disposed shelf into the holes defined by said divider for retaining said divider in place relative to said adjacent shelves whereby the shelves and dividers define storage bins for the storing of articles therein.

2. A display system as set forth in claim 1 in which the wire bracket is generally U-shaped in which the legs fit into the shelf openings and the upper portion thereof defines U-shaped projections that fit into said slot.

3. A display system as set forth in claim 2 in which the U-shaped bracket defines a central portion that engages said shelf to limit the depth at which its legs penetrate the shelf openings.

4. A display system as set forth in claim 1 in which the uppermost divider is secured to its upper shelf by a U-shaped bracket including a pair of legs and a generally flat portion therebetween in which the legs thereof fit through said upper shelf into said divider holes and the flat portion of said bracket rests on said upper shelf.

5. A display system comprising a plurality of vertically spaced shelves and dividers forming a bin construction, means for supporting the shelves in position relative to a shelf support, means for retaining a plurality of transversely spaced vertically disposed dividers in position relative to vertically spaced shelves, at least some of said dividers defining an upwardly extending C-shaped groove in their upper surfaces adjacent their front ends, and a transversely extending generally J-shaped member having a vertical leg and a lower leg in which the lower leg includes a portion that snaps into said C-shaped groove and its generally vertical leg extends between the upper end of its respective divider and adjacent shelf, and additional dividers and retaining means being provided in vertically and transversely spaced relationship whereby the shelves and dividers define storage bins for the storing of articles therein.

6. A display system as set forth in claim 5 in which the generally vertical leg of said J-shaped member defines a track for receiving advertising material detailing what is present in an adjacent bin.

7. A display system as set forth in claim 5 in which the lower leg defines an inverted T-shaped segment having a relatively large horizontal portion being constructed and arranged to snap into said adjacent C-shaped grooves to retain said J-shaped members in position relative to adjacent vertically disposed dividers and a leg extending normal thereto.

8. A display system as set forth in claim 7 in which the leg of the T-shaped segment defines flanges opposite said relatively large horizontal portion to facilitate pushing of said relatively large horizontal portion into the groove.

9. A display system as set forth in claim 8 in which the generally vertical leg of said J-shaped member defines a track for receiving advertising material detailing what is present in the adjacent bin.

10. A method of forming a bin-type display system consisting of providing a gondola shelf support construction, locating shelves on said gondola in vertically spaced relationship, providing dividers between pairs of vertically spaced shelves by placing a wire bracket in position relative to a first shelf, providing a divider with a groove and sliding the divider over the bracket to where the bracket fits within the divider groove, pinning the divider to a second adjacent vertically spaced shelf by locating pins through the shelf and into holes located in the divider, providing a second vertically spaced divider by introducing a second divider with the pins fit into a groove in the second divider to retain the bottom of the second divider in position relative to said second shelf, and subsequently introducing pins through a third vertically spaced shelf into holes in the divider to maintain that divider in position relative to adjacent shelves and continuing this method until dividers are located between adjacent vertical shelves and in transversely spaced relation to form a bin.

11. A method as set forth in claim 10 in which the divider located between an uppermost shelf having an upper surface and an immediately adjacent lower shelf is maintained in position by a U-shaped wire bracket having legs that extend through the upper shelf into holes formed in the upper surface of the last mentioned divider to locate said divider in position without projections extending above said uppermost shelf.

12. A method as set forth in claim 10 including the step of including advertising graphic material in the display system by providing adjacent dividers with C-shaped grooves in their upper front end portions and locating in said grooves flexible horizontal leg portions of transversely extending generally J-shaped members with the vertical legs of said J-shaped members constructed and arranged to contain advertising material.

* * * * *